United States Patent [19]

Righini

[11] Patent Number: 4,684,029

[45] Date of Patent: Aug. 4, 1987

[54] DISPLAY STAND

[76] Inventor: Roy Righini, 12 Tillock Street, Thornleigh 2120, New South Wales, Australia

[21] Appl. No.: 793,836

[22] Filed: Nov. 1, 1985

[51] Int. Cl.[4] ..... A47E 29/00

[52] U.S. Cl. ..... 211/78; 211/163; 211/207; 40/152.1; 40/606; 40/607; 40/479; 40/611; 248/200.1

[58] Field of Search ..... 211/78, 163, 189, 190, 211/207, 107; 40/152.1, 606, 607, 479, 611, 490; 248/354.1, 1, 544, 200.1, 219.1, 418; 16/256, 280, 284, 285, 297, 303, 334

[56] References Cited

U.S. PATENT DOCUMENTS

| | | | |
|---|---|---|---|
| 3,350,120 | 10/1967 | Hinrichs | 248/200.1 X |
| 3,593,857 | 7/1971 | Henes | 248/200.1 X |
| 3,595,209 | 7/1971 | Parker | 211/78 X |
| 3,785,499 | 1/1974 | Gedye | 211/163 X |
| 4,439,940 | 4/1984 | Deryk | 40/607 X |

FOREIGN PATENT DOCUMENTS

| | | | |
|---|---|---|---|
| 82833 | 3/1935 | Sweden | 40/607 |
| 173449 | 11/1960 | Sweden | 211/41 |

*Primary Examiner*—Ramon S. Britts
*Assistant Examiner*—Blair M. Johnson
*Attorney, Agent, or Firm*—Anthony A. O'Brien

[57] ABSTRACT

A display stand comprising a generally rectangular frame with an array of individually manually rotatable vertical or horizontal shafts extending between two opposed frame sides. A number of aligned holders for printed sheets mounted on each shaft. The spacing of the shafts being such that they can be rotated without the holders of adjacent shafts coming into contact and without the holders on the end shafts in the array coming into contact with the other sides of the frame. Catch means is provided to position the shafts in anyone of a number of predetermined rotational positions.

6 Claims, 9 Drawing Figures

FIG. 6.
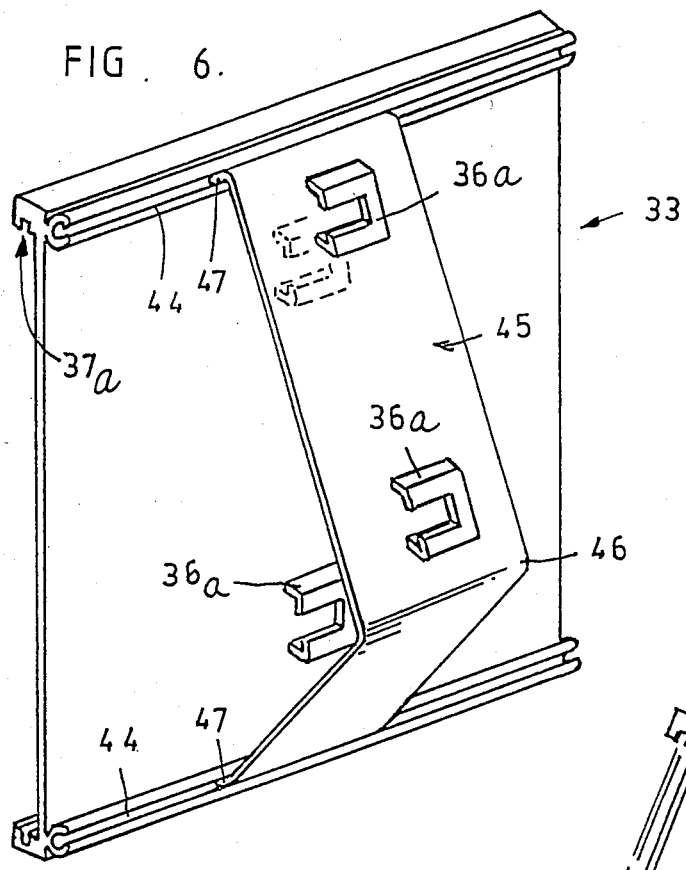
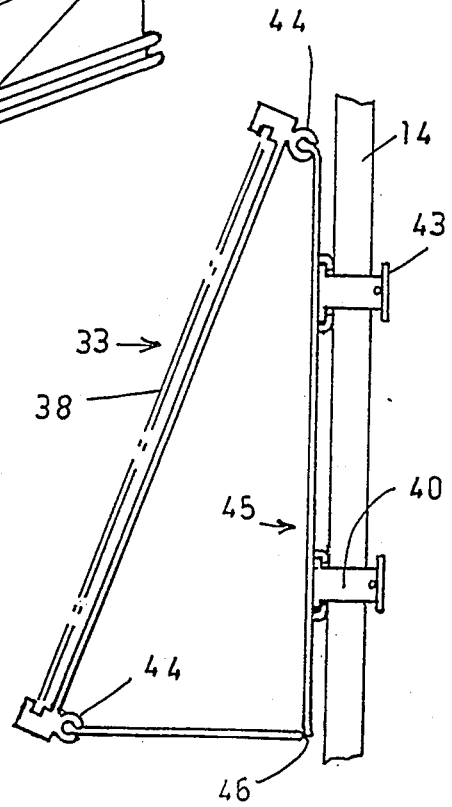
FIG. 7.

FIG. 8.
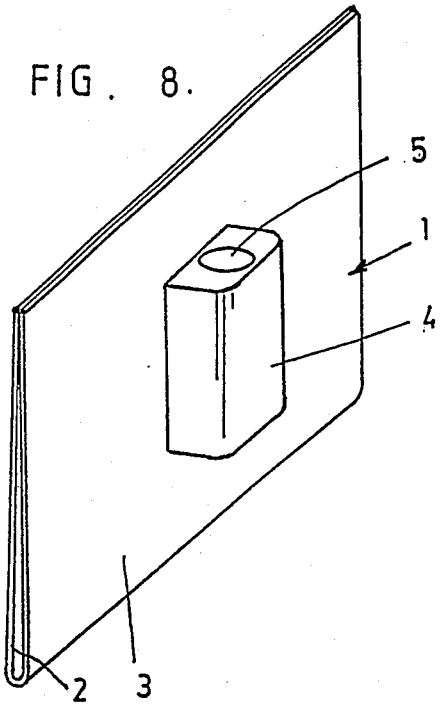
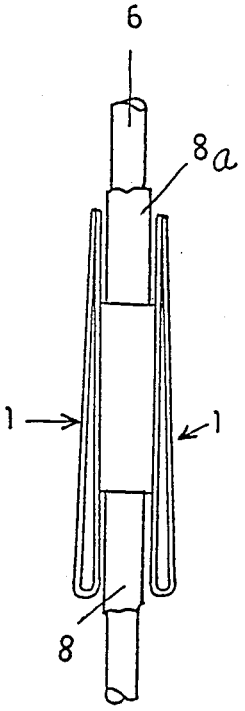
FIG. 9.

DISPLAY STAND

This invention relates to a display stand which includes movable elements on which articles to be displayed are mounted. The movable elements can be rotationally positioned in accordance with user requirements.

The invention has been primarily, but not exclusively, devised for the display of photographs or illustrations in shop windows. In a typical arrangement in a real estate agency a display stand according to the invention would carry photographs of a number of homes for sale. The photographs would be respectively mounted in photograph holders mounted on supporting members. The supporting members and/or the photograph holders are rotatable by a person within the agency to gain access to the photographs so that they can be changed for other photographs or so that they can be removed to provide a prospective buyer of a property with a better view of the photograph. The photographs normally face the footpath outside the agency so that the photographs can be seen by a prospective buyer looking through the real estate agency window.

In the past photographs have been laboriously slid along fixed tracks on a mounting board in the agency window in order to position them so that they can be seen through the window to passing persons. This has made photograph replacement a time-consuming operation and made it impractical for a prospective buyer to see the photograph except by examination through the window of the agency. This has not been satisfactory and has led in some cases to adverse buyer reaction.

The present invention overcomes the above problems. It is to be understood that the example given is only that, and the invention has applications outside the real estate example given.

The invention can be broadly said to comprise a display stand comprising a generally rectangular supporting frame, an array of individually manually rotatable parallel shafts, a plurality of aligned holders secured to each shaft so as to be rotatable with said shaft, each holder being adapted to demountably support articles to be exhibited on the display stand, the respective ends of said shafts are mounted on two opposite sides of said frame with releasable catch means at least at one end of each shaft allowing said shafts to be releasably retained in predetermined rotational positions, the first and last shafts in said array being spaced sufficiently from the other sides of said frame to allow those shafts to rotate without the holders thereon contacting said other frame sides and the spacing between adjacent shafts being such that they can be rotated without the holders thereon contacting the holders on an adjacent shaft.

Figure 1:
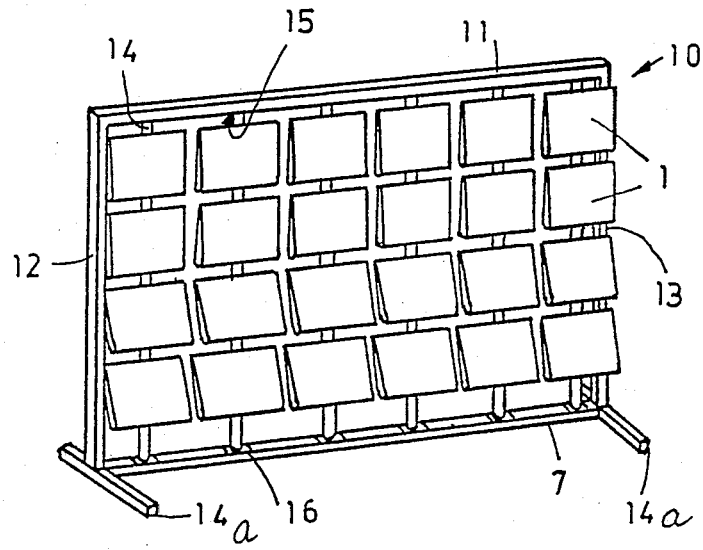
Figure 2:
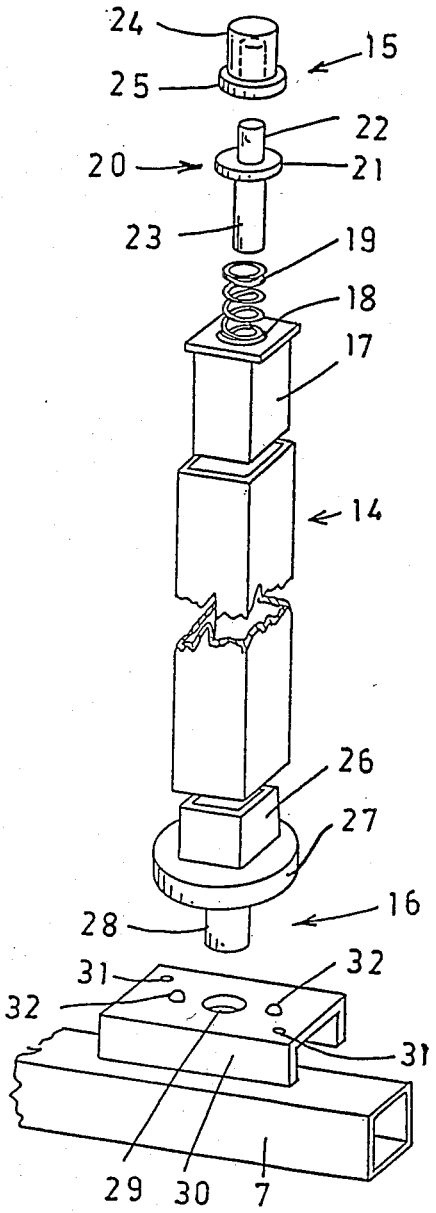
Figure 5:
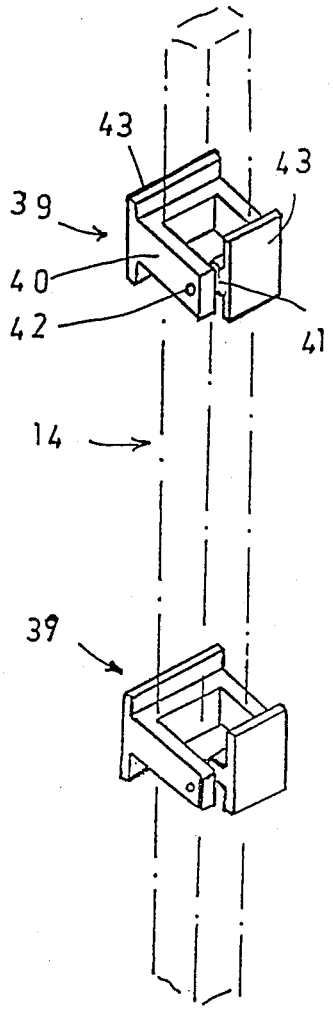
Figure 3:
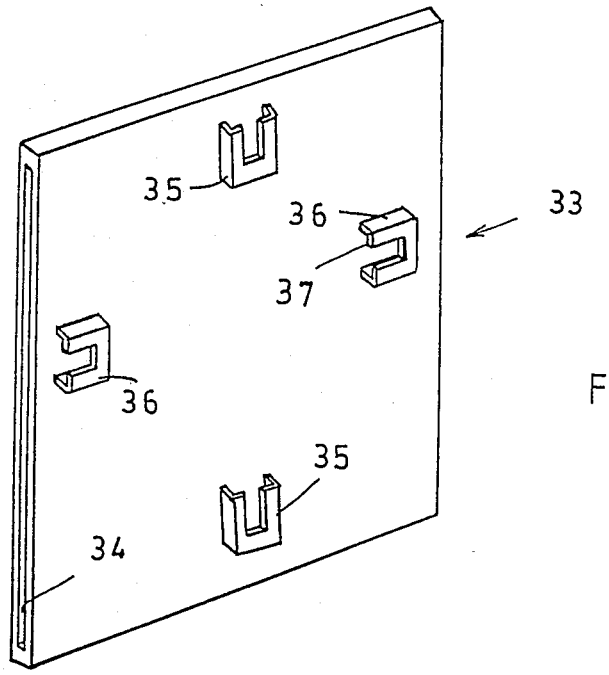
Figure 4:
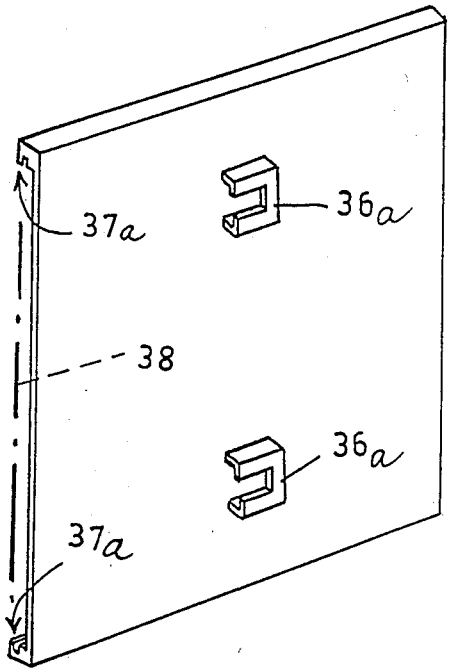

Several presently preferred forms of the invention will now be described with reference to the accompanying drawings in which:

FIG. 1 is a representative arrangement of a display stand according to the invention wherein several shafts are provided each with a number of photograph holders thereon;

FIG. 2 is an exploded perspective view of the components of a rotatable shaft of a presently preferred form, FIG. 3 is a rear perspective view of a first form of photograph holder, FIG. 4 is a rear perspective view of a second form of photograph holder, FIG. 5 is a perspective view showing two connectors of the type used to mount a photograph holder as shown in FIGS. 3 and 4 on a shaft, shown in broken outline, FIG. 6 is a rear perspective view of a third form of a photograph holder with an associated support member whereby the photograph in the photograph holder is located in a plane other than the vertical plane, which is the normal orientation, FIG. 7 is an end view showing a photograph holder mounted on a shaft through a support member as illustrated in FIG. 6, FIG. 8 is a rear perspective view of a photograph holder of another and single type, FIG. 9 is an end view of a photograph holder of the type shown in FIG. 8 but double sided and which is mounted on a shaft for rotation thereon.

For the purposes of simplicity the basic form of the invention as shown in FIGS. 8 and 9 will be described first. As illustrated in FIG. 8 the holder 1 comprises a folded sheet of transparent acrylic material to provide a front panel 2 and a rear panel 3 with the panels 2 and 3 resiliently engaging at the upper edges. There is thus provided a holder in which a photograph is resiliently sandwiched between at least parts of the members 2 and 3. There is a boss 4 on the rear face of the panel 3 with a circular cross-section hole 5 therethrough.

In FIG. 9 a double sided holder for photograph back to back with the boss 4 providing the connection between the members 1 is mounted on a cylindrical shaft 6. The lower end of the shaft is supported rotatably or non-rotatably in the bottom rail 7 of a mounting frame, to be discussed later in detail. There is a sleeve 8 over the shaft 6 and the holder is supported at a required elevation above the rail 7 by engagement of the lower end of the boss 4 with the upper end of the sleeve 8. There is a similar sleeve **8*a* over the shaft 6 above the boss 4 and a second holder 1 mounted on the shaft is spaced from the holder 1 illustrated by an amount dependent upon the length of the upper sleeve 8*a*. Several holders 1** can be mounted on a shaft and several shafts can be mounted in a frame. In the described arrangement the shaft would be fixed and the holders would rotate thereon.

In a variation of the foregoing the shaft would be rotatably mounted at its ends in upper and lower frame rails and fastening means mounted in the boss 4 and engaging the shaft would located the holders 1 vertically on the shaft. In such an arrangement the shaft with all the attached holders would rotate. Preferably with the latter arrangement locating means would be provided so the shaft could be retained in anyone of several predetermined rotational positions. Typical rotational locating means will be described later.

The preferred form of the invention will now be described. In FIG. 1 a generally rectangular frame 10 is illustrated with a bottom rail 7 and a top rail 11, sides 12 and 13 provided with feet members **14*a*. A number of posts 14 are mounted rotatably in the frame through upper and lower bearing means 15 and 16. A number of photograph holders is mounted on each post 14. FIG. 2 illustrates the posts 14 and the bearing means 15 and 16 in detail. The post 14** is tubular and square in section.

The upper bearing means comprises a plug 17 of square section to be tight fit in the tube 14 with a shoulder to limit the penetration of the plug 14 into the tube 14. There is a central blind hole 18 in the plug 17 and a compression spring 19 is housed in the hole 18. There is a spigot member 20 comprised of a central shoulder 21 and upper and lower pintles 22 and 23. The lower pintle 23 is a sliding fit in the hole 18 and rest upon the top of the spring 19. The upper pintle 22 is a sliding fit in the bore of a bush having a body 24 to engage in a hole in the top rail 15 and a shoulder 25 to limit the penetration of the body 24 into the rail 15.

The lower bearing means 16 comprises a plug 26 which is a tight fit in the tube 14 and there is a large circular shoulder 27 to limit the penetration of the plug 26 into the tube 14. Projecting from the underface of the shoulder 27 there is a pintle 28 sized to engage in a hole 29 in a saddle 30 which is fixed to the rail 7 by rivets or screws indicated generally 31. There is a hole in the rail 7 aligned with the saddle hole 29 to permit the pintle 28 to enter the rail 7. There are upstanding diametrically located heads 32 on the saddle 30 equally spaced from the axis of the hole 29 and there are dimples 99 on the underface of the shoulder 27 which when engaged with the heads 32 will locate the shaft 14 in anyone of several predetermined rotational positions.

When the shaft is mounted in the frame the shoulder 21 and 25 of the upper bearing means are urged into engagement by the spring 19. Clearance is allowed between the upper end of the plug 17 and the shoulder 21 so that the shaft 14 with the plugs 17 and 26 fixed therein can rise as the dimples on the shoulder 27 are sequentially engaged on the heads 32 as the shaft 14 is rotated. The allowed clearance is also sufficient for disengagement of the pintle 22 from the bore of the bush body 24. By lateral movement of the top of the shaft 14 after such disengagement the shaft can be raised upwardly to disengage the the pintle 28 from the hole 29. The shaft is thereby freed from the frame to allow the mounting thereon of holders 1.

The holders illustrated in FIGS. 3 and 4 differ from the holders of FIGS. 8 and 9 in several ways. The FIG. 3 holder identified 33 has a longitudinal narrow rectangular slot 34 to house a photograph.

The holder of FIG. 3 has rear attachment sockets arranged in pairs. One pair of sockets 35—35 enables the holder to be mounted on a horizontal shaft, an arrangement contemplated by this invention. The other pair of sockets 36 are for mounting the holder on a vertical shaft. In both the sockets 35 and 36 cutaways are provided to form shoulders 37. The shoulders 37 are for engagement with flanges on holder supports 39 which are illustrated in FIG. 5 and are described later.

The FIG. 4 holder has sockets 36 but a different arrangement for housing a photograph. In the FIG. 4 holder there are grooved upper and lower flanges 37*a* in which a slidably removable transparent sheet 38 is mounted. The FIG. 4 arrangement is simpler to manufacture than the FIG. 3 arrangement.

FIG. 5 illustrated two holder supports 39 positioned on a shaft 14, shown in broken outline. Each holder support comprises a ring 40 of square form with a slot 41 therethrough to allow a clamping action to fix the support 39 to the shaft 14 as a screw 42 is tightened. Along opposite sides of the ring 40 there are flanges 43 to be engaged in the sockets 35 or FIG. 3 or 36*a* of FIG. 4 with a firm frictional engagement. In this way the holders can be readily mounted on and removed from the shaft 14.

FIG. 6 illustrates how a holder can be supported in such a way as to present its front at an angle to the vertical, see the lower rows of holders in FIG. 1. The holder has upper and lower edge tracks 44 which are largely circular in cross-section and are slightly greater that 180 degrees in extent. A coupling member 45 is provided. It has a lateral hinge zone 46 and upper and lower end ridges 47. Because of the ability of the member 45 to hinge the ridges 47, which are largely circular in cross-section and are substantially the same size as the tracks 44, can be snap fitted into the tracks. The member 45 has on its rear face sockets 36*a* allowing the member 45 to be mounted on a mast to provide the configuration shown in FIG. 7 and in the lower rows of holders in FIG. 1. The angle of the holder can be varied by using a member 45 with a differently located hinge zone.

As will be understood the invention resides in the concept of mounting rotatable photograph or like holders in columns and/or rows so that the holders of one column (or row) will not foul the holders of an adjacent column (or row) or the adjacent frame side when holders are rotated. The specific arrangements for mounting the holders and supporting the shafts in the frame are given by way of example and whilst some of these are clearly inventive those inventions are secondary to the inventive concept defined in the accompanying claims.

I claim:

1. A display stand comprising a support frame having two parallel side members and two parallel end members defining a rectangular opening, first bearing means on one of the side members, second bearing means on the other side member with respective first and second bearing means aligned to mount shaft assemblies in parallel relationship in the frame opening, a number of individually manually rotatable parallel shaft assemblies mounted in the bearing means, each shaft assembly comprising a body of rectangular cross-section, a spigot extending from one end of the shaft assembly body and fixed thereto and inserted into one of the first bearing means, a socket in the other end of the shaft assembly body, a plunger including a shoulder intermediate it's ends, a compression spring housed in the socket engaging an end face of one end of the plunger housed in the socket, the other end of the plunger is housed in one of the second bearing means with the plunger shoulder biassed into engagement with the second bearing means by the compression spring, holders for sheet objects to be displayed, clamping means on each holder embracing a shaft assembly body whereby the holder can be positioned as required along the length of the shaft assembly body, the shaft assemblies being spaced apart and from the ends of the frame sufficiently allowing the shaft assemblies to be rotated without the holders on adjacent shafts contacting each other and the holders on the end shafts contacting the ends of the frame, and releasable positioning means locating the shaft assemblies in predetermined rotational positions, the positioning means comprising detent means between a flange around and fixed to spigot of each shaft assembly and the first bearing means associated therewith, the detent means being maintained in engagement by the action of the spring on the end face of the plunger of the shaft assembly and being releasable by manual rotation of the shaft assembly to overcome the detent engagement and cause axial movement of the shaft assembly body axially relative to the plunger with associated further compression of the compression spring.

2. A display stand as claimed in claim 1, including socket means on the rear of each holder, each socket means includes a "T" shaped slot, and the clamping means includes a body with flanges defining a "T" slidingly engaged in tight manner in the "T" shaped slot.

3. A display stand as claimed in claim 1, wherein the shaft assembly body is tubular and of square cross-section, further comprising a first plug in the said one end of the shaft assembly body, the first plug comprising a shank which is a tight fit in the square cross-sectional interior of the shaft assembly body, a flange concentric with the shank and a spigot which extends from the flange; a second plug in the said other end of the shaft assembly body, the second plug comprising a shank which is a tight fit in the square cross-sectional interior of the shaft assembly body with a central socket in the second plug housing the compression spring and the first end of the plunger.

4. A display stand as claimed in claim 1 wherein the detent means comprises two diametrically disposed upstanding projections on the first bearing means equidistant from the axis of the spigot housed in the first bearing means and pairs of complementarily shaped and disposed recesses in the flange for engagement with the projections whereby the shaft assembly can be positively located in predetermined rotational positions.

5. A display stand as claimed in claim 1, wherein the first bearing means is a bearing block secured to the said one side of the frame with an opening therein in which the spigot of the shaft assembly body is housed and the second bearing means has a tubular body with a body flange at one end, the tubular body is a tight fit in a hold in the said other side of the frame and the body flange is in abutting engagement with the said other side of the frame.

6. A display stand as claimed in claim 1, including an angled support on the holder, the angled support having two sockets each including a "T" shaped slot, and the clamping means includes two clamping elements clamped about the shaft assembly body, the clamping elements each having a body and flanges defining a "T" respectively engaged in tight manner in the "T" shaped slots of the sockets, the angled support locating the holder so that the sheet object displayed in the holder is in a plane at a predetermined angle to the plane of the axis of rotation of the shaft assembly.

* * * * *